US012460889B1

(12) United States Patent
Bernstein et al.

(10) Patent No.: US 12,460,889 B1
(45) Date of Patent: Nov. 4, 2025

(54) SUPPRESSOR CONNECTOR FOR FIREARMS

(71) Applicant: Irregular Design Group, LLC, Lancaster, OH (US)

(72) Inventors: Sean Bernstein, Lancaster, OH (US); Slade Cutrer, Grants Pass, OR (US)

(73) Assignee: Irregular Design Group, LLC, Lancaster, OH (US)

( * ) Notice: Subject to any disclaimer, the term of this patent is extended or adjusted under 35 U.S.C. 154(b) by 0 days.

(21) Appl. No.: 19/215,101

(22) Filed: May 21, 2025

Related U.S. Application Data

(63) Continuation of application No. 19/193,775, filed on Apr. 29, 2025, now abandoned, which is a continuation of application No. 19/078,617, filed on Mar. 13, 2025.

(51) Int. Cl.
*F41A 21/32* (2006.01)

(52) U.S. Cl.
CPC ..... *F41A 21/325* (2013.01)

(58) Field of Classification Search
CPC ..... F41A 21/30–38
USPC ..... 89/14.05, 14.2–14.4; 181/223
See application file for complete search history.

(56) References Cited

U.S. PATENT DOCUMENTS 3,202,056 A * 8/1965 Seeberger ..... F41A 21/36 89/14.3
4,510,843 A * 4/1985 Rabatin ..... F41A 21/325 89/14.4
5,509,345 A * 4/1996 Cyktich ..... F41A 21/36 89/14.05
5,773,746 A * 6/1998 Vaden ..... F41A 21/325 89/14.4
5,860,242 A * 1/1999 O'Neil ..... F41C 27/22 89/14.3
6,385,891 B1 * 5/2002 Rabatin ..... F41A 21/325 42/79
6,557,290 B2 * 5/2003 Kumler ..... F41A 21/42 42/79
9,500,427 B1 * 11/2016 Larue ..... F41A 21/30
10,508,878 B1 * 12/2019 Oglesby ..... F41A 21/36
10,670,362 B2 * 6/2020 Wilson ..... B23K 35/3033
10,996,015 B2 * 5/2021 Lee ..... F41A 21/30
11,092,400 B2 * 8/2021 Moller ..... F41A 21/325
2018/0038663 A1 * 2/2018 Larue ..... F41A 21/30
2018/0058791 A1 * 3/2018 Larue ..... F41A 21/325
(Continued)

*Primary Examiner* — Troy Chambers
*Assistant Examiner* — Benjamin S Gomberg
(74) *Attorney, Agent, or Firm* — Scott D. Smiley; Scott M. Garrett; The Concept Law Group, P.A.

(57) ABSTRACT

A suppressor connector has distal end threads operable to couple the suppressor connector to a suppressor device and proximal end threads operable to couple to a muzzle of a firearm. At least one flexible pawl is coupled to the suppressor connector and has a free-floating proximal end that terminates beyond the proximal thread end of the set of proximal end threads of the suppressor connector and has an engagement face on the free-floating proximal end. At least one outer hood has a distal end coupled to the suppressor connector proximate to the distal end of the flexible pawl and a free-floating proximal end that at least partially covers the free-floating proximal end of the flexible pawl and that extends beyond and substantially parallel to the free-floating proximal end of the flexible pawl.

20 Claims, 7 Drawing Sheets

(56) References Cited

U.S. PATENT DOCUMENTS

| | | | | |
|---|---|---|---|---|
| 2020/0300578 | A1* | 9/2020 | Phillips | F41C 27/20 |
| 2022/0099122 | A1* | 3/2022 | Gomez | F16B 21/16 |
| 2023/0266089 | A1* | 8/2023 | Krnezic | F41A 21/36 89/14.3 |

* cited by examiner

200

100

200

200

SUPPRESSOR CONNECTOR FOR FIREARMS

CROSS REFERENCE

This application is a continuation of application Ser. No. 19/193,775, filed on Apr. 29, 2025, which is a continuation of application Ser. No. 19/078,617 filed on Mar. 13, 2025, the entire contents of which are incorporated by reference herein.

FIELD OF THE INVENTION

The present invention relates generally to suppressors for firearms, and, more particularly, relates to a suppressor connector with features that prevent the suppressor from dislodging from its installed position.

BACKGROUND OF THE INVENTION

A suppressor, often referred to as a silencer, is a cylindrical device attached to the muzzle of a firearm to reduce the noise, muzzle flash, and recoil generated when a gun is fired. It works by slowing and cooling the escaping gases that are rapidly expelled from the barrel as the bullet exits, thereby diminishing the sound intensity and reducing the sharpness of the gunshot. Suppressors are commonly used in shooting sports, hunting, and tactical applications to protect hearing, minimize disturbance in outdoor environments, and maintain situational stealth.

Certain firearms are designed with integrated suppressors that are permanently fixed to the barrel. These suppressors cannot be removed and are an integral part of the firearm's design. This is typically an undesirable configuration because, while suppressors provide advantages in reducing sound, they are not always desirable to have attached to the firearm. Suppressors add significant length and weight to the firearm, which can affect handling, maneuverability, and balance. This is particularly noticeable on rifles or when operating in confined spaces. Suppressors can become extremely hot after extended firing, increasing the risk of burns if touched accidentally. The heat can also create "mirage" effects that distort sight, especially with optics. Suppressors trap gases, which can lead to an increase in blowback toward the shooter, potentially making shooting uncomfortable and exposing the shooter to more carbon residue. In many jurisdictions, owning a suppressor involves significant legal restrictions, such as lengthy approval processes, taxes, and additional documentation. Finally, suppressors need regular cleaning and maintenance to remove carbon buildup, which can affect performance if neglected. For all of these reasons and more, it is advantageous to be able to easily remove and reattach a suppressor to the muzzle of a firearm.

Suppressors are most commonly attached as an add-on accessory to the muzzle of a firearm through one of several mechanisms designed to ensure a secure and aligned fit. Prior-art methods of attachment vary based on the firearm and suppressor design. In a direct-thread arrangement, the suppressor screws directly onto the firearm's threaded muzzle. This is the most common and straightforward method. The barrel must have compatible threads that match the suppressor's threading. Direct-thread suppressors provide a secure fit but require periodic tightening during use to maintain alignment, which is critically important when shooting ammunition through the barrel of the firearm.

Failure to have perfect alignment can have devastating and dangerous effects to the firearm, the user, and those around the firearm.

A suppressor hybrid universal base (HUB) mount has become the industry standard for suppressor mounting and simplifies muzzle attachment methods. It features a proximal end that couples to the firearm and a distal end that couples to a suppressor. The distal end has threads that typically measure 1.375×24 (also expressed as 1⅜×24) threads per inch (TPI) and that couple with corresponding threads on the base of the suppressor. This standardized thread metric means users have a wide variety of suppressor accessories to choose from instead of being locked into proprietary systems or only using muzzle devices from a specific manufacturer.

The proximal end of the HUB attaches to a specialized muzzle device that is semi-permanently installed on the firearm's muzzle. One such prior-art muzzle device 100 is shown in FIG. 1. The muzzle device 100 includes muzzle device threads 102 that mate with corresponding threads on a HUB or suppressor. A bore alignment taper 104 ensures that the HUB or suppressor makes full contact with the muzzle device 100 and can be securely tightened onto the muzzle device 100. The muzzle device has an engagement ring 106 with a plurality of engagement teeth 108. The engagement teeth 108 on the muzzle device 100 are used to prevent the silencer/suppressor from coming unattached to the firearm. The engagement teeth 108 are finely machined into the steel muzzle, forming a circular arrangement of evenly spaced notches and grooves. Each tooth is angular and designed to interact with a locking mechanism of a silencer/suppressor to keep the silencer/suppressor firmly in place during use. A problem that firearm owns are experiencing is that, while the edges of the engagement teeth 108 ensure a secure fit, they wear themselves down and, even more so, wear down the corresponding portions of the silencer over time from repeated attachment and removal.

Therefore, a need exists to overcome the problems with the prior art as discussed above.

SUMMARY OF THE INVENTION

The invention provides a suppressor connector for firearms that overcomes the hereinbefore-mentioned disadvantages of the heretofore-known devices and methods of this general type and that allows a suppressor to be quickly and easily connected to and disconnected from the muzzle of a firearm in a way that prevents the connector from coming loose prior to its desired removal by a user.

With the foregoing and other objects in view, there is provided, in accordance with the invention, a suppressor connector has a distal end with distal end threads that are operable to couple the suppressor connector to a suppressor device, a proximal end with proximal end threads that are operable to couple the suppressor connector to a muzzle of a firearm, the proximal end threads having a distal thread end and a proximal thread end, at least one flexible pawl with a distal end coupled to the suppressor connector proximate to the distal thread end of the proximal end threads, a free-floating proximal end that terminates beyond the proximal thread end of the set of proximal end threads of the suppressor connector, and an engagement face on the free-floating proximal end. At least one outer hood has a distal end coupled to the suppressor connector proximate to the distal end of the flexible pawl and a free-floating proximal end that at least partially covers the free-floating proximal end of the flexible pawl and that extends beyond and substantially parallel to the free-floating proximal end of the flexible pawl.

Implementations may include one or more of the following features. The suppressor connector may include a bore alignment taper at a distal end of the distal end threads of the distal end of the suppressor connector. The suppressor connector may include a length of the at least one flexible pawl extending between the proximal and distal ends of the at least one flexible pawl is flexibly movable with respect to the proximal end threads.

In accordance with a further feature of the present invention, a length of the at least one flexible pawl extending between the proximal and distal ends of the at least one flexible pawl is flexibly movable with respect to the at least one outer hood. In accordance with a another feature of the present invention, the length of the at least one flexible pawl extending between the proximal and distal ends of the at least one flexible pawl extends parallel to the proximal end threads. In accordance with one more feature of the present invention, a length of the at least one flexible pawl extending between the proximal and distal ends of the at least one flexible pawl defines a gap between the length of the flexible pawl and an outside surface of the proximal end threads. In accordance with a further feature of the present invention, a length of the at least one flexible pawl extending between the proximal and distal ends of the at least one flexible pawl defines a gap between the length of the flexible pawl and an inside surface of the at least one outer hood. In accordance with yet another feature of the present invention, the at least one outer hood substantially surrounds the at least one flexible pawl on three sides thereof. In accordance with one more feature of the present invention, the engagement face of the at least one flexible pawl is in substantial longitudinal alignment with the proximal end threads.

One general aspect of the present invention includes a method of coupling a suppressor to a firearm that includes the steps of providing a muzzle device having an engagement ring, a plurality of engagement teeth, and a set of threads. An additional step includes providing a suppressor connector having a distal end with distal end threads that are operable to couple the suppressor connector to a suppressor device. A proximal end with proximal end threads are operable to couple the suppressor connector to the muzzle device and the proximal end threads have a distal thread end and a proximal thread end. The method also includes providing at least one flexible pawl having a distal end coupled to the suppressor connector proximate to the distal thread end of the proximal end threads, a free-floating proximal end that terminates beyond the proximal thread end of the set of proximal end threads of the suppressor connector, and an engagement face on the free-floating proximal end. An embodiment of the method also includes providing at least one outer hood having a distal end coupled to the suppressor connector proximate to the distal end of the flexible pawl, and a free-floating proximal end that at least partially covers the free-floating proximal end of the flexible pawl and that extends beyond and substantially parallel to the free-floating proximal end of the flexible pawl, and coupling the suppressor connector to the muzzle device.

Implementations may include one or more of the following features. The method where the step of coupling the suppressor connector to the muzzle device may include placing the suppressor connector in physical contact with the muzzle device and rotating the suppressor connector relative to the muzzle device. The method may include coupling the suppressor to the suppressor connector prior to the step of coupling the suppressor connector to the muzzle device. The suppressor connector may include a bore alignment taper at a distal end of the distal end threads of the distal end of the suppressor connector. In accordance with a further feature of the present invention, a length of the at least one flexible pawl extending between the proximal and distal ends of the at least one flexible pawl is flexibly movable with respect to the proximal end threads. In accordance with another feature of the present invention, a length of the at least one flexible pawl extending between the proximal and distal ends of the at least one flexible pawl is flexibly movable with respect to the at least one outer hood. In accordance with one more feature of the present invention, the length of the at least one flexible pawl extending between the proximal and distal ends of the at least one flexible pawl extends parallel to the proximal end threads. In accordance with an additional feature of the present invention, a length of the at least one flexible pawl extending between the proximal and distal ends of the at least one flexible pawl defines a gap between the length of the flexible pawl and an outside surface of the proximal end threads.

Although the invention is illustrated and described herein as embodied in a suppressor connector for firearms, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down," "left," "right," "inside," "outside," "front," "back," "head," "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first," "second," "third," and so on are only used for descriptive purposes and cannot be construed as indicating or implying relative importance.

In the description of the embodiments of the present invention, it should be noted that, unless otherwise clearly defined and limited, terms such as "installed," "coupled," "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances, these terms may include numbers that are rounded to the nearest significant figure. In this document, the term "longitudinal" should be understood to mean in a direction corresponding to an elongated direction of the barrel of a firearm to which the present invention is installed. Those skilled in the art can understand the specific meanings of the above-mentioned terms in the embodiments of the present invention according to the specific circumstances.

Conjunctive language such as the phrase "at least one of X, Y, and Z," unless specifically stated otherwise, is generally understood to convey that an item, term, etc. may be either X, Y, or Z. Thus, such conjunctive language is not generally intended to imply that certain embodiments require at least one of X, at least one of Y, and at least one of Z to each be present.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
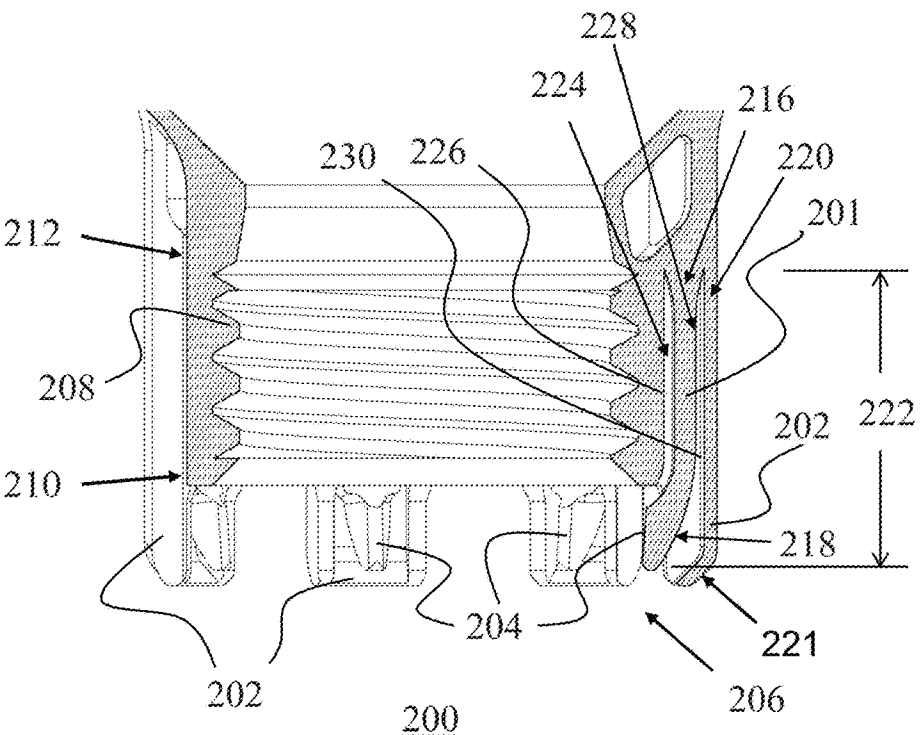
FIG. 2 is a fragmentary, side elevational view of a suppressor connector for firearms, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a suppressor connector that allows for quick and convenient secure attachment and detachment of a suppressor to a muzzle of a firearm. Referring now to the fragmentary, side, elevational view, of a suppressor connector 200 in FIG. 2 and the perspective view of the distal end of the full suppressor connector for firearms in FIG. 3, an embodiment of the present invention, is shown. The suppressor connector 200 includes a distal end 302 (shown in FIG. 3) with distal end threads 304 that are operable to couple the suppressor connector 300 to a suppressor device 700 (shown in FIG. 7). The threads 304 can be standard threads and can be made of any suitable material, preferably metal, and that can secure two components to each other. In one embodiment, the threads are 1.375×24 (also expressed as 1⅜×24) per inch (TPI). The invention is not limited, however, to any particular thread dimensions.

Referring again to FIG. 2, the suppressor connector 200 also includes a proximal end 206 with proximal end threads 208 that are operable to couple the suppressor connector 200 to a muzzle device 100 of a firearm. The proximal end threads 208, in accordance with one embodiment, have a distal thread end 212 and a proximal thread end 210.

The suppressor connector 200 includes at least one flexible pawl 201 and typically includes a plurality of flexible pawls 201, e.g., eight, that form a circle. "Flexible," as used herein, is intended to indicate a structure that is capable of bending/moving within a certain range of movement without breaking and then returning with spring force to its original position/shape. The number of flexible pawls 201 is not limited to any particular number and can change, depending on several factors, such as the material the pawls are made from, the gripping strength required by the suppressor connector 200, and others.

As shown in FIG. 2, each flexible pawl 201 features a distal end 216 coupled to the suppressor connector proximate to the distal thread end 212 of the proximal end threads 208. A free-floating proximal end 218 of each flexible pawl 201 terminates beyond the proximal thread end 210 of the set of proximal end threads 208 of the suppressor connector 300. The term "free-floating," as used herein, is intended to indicate a structure that is "not attached to anything and able to move freely." As such, the free-floating proximal end 218 is able to flex, i.e., bend/move freely and return to its original position, when a force is placed on it.

Each flexible pawl 201 also has an engagement face 204 on its free-floating proximal end 218. The engagement face 204 is the portion that, as described in more detail below, makes the most contact with the engagement ring 106 and, in particular, with the engagement teeth 108.

Figure 4:
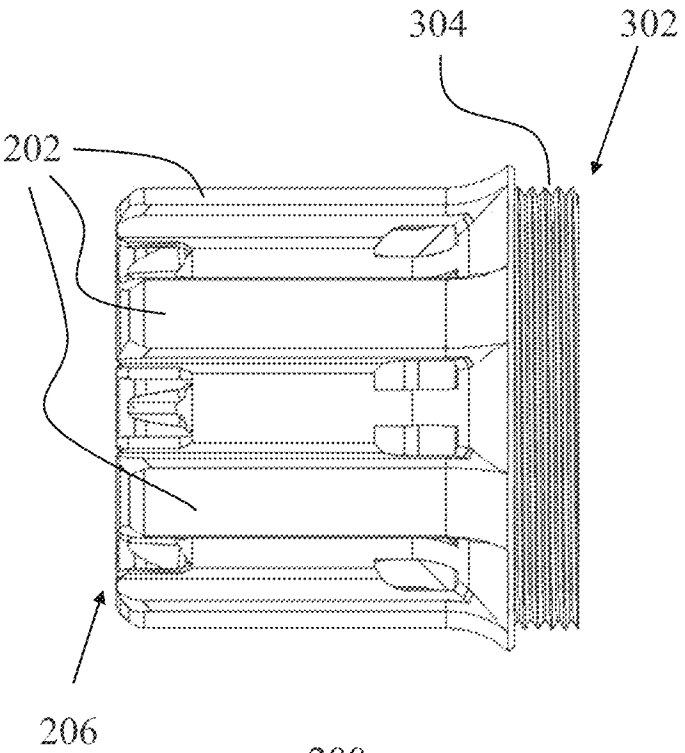
FIG. 4 is a side elevational view of the suppressor connector for firearms of FIG. 2, in accordance with the present invention.
Figure 3:
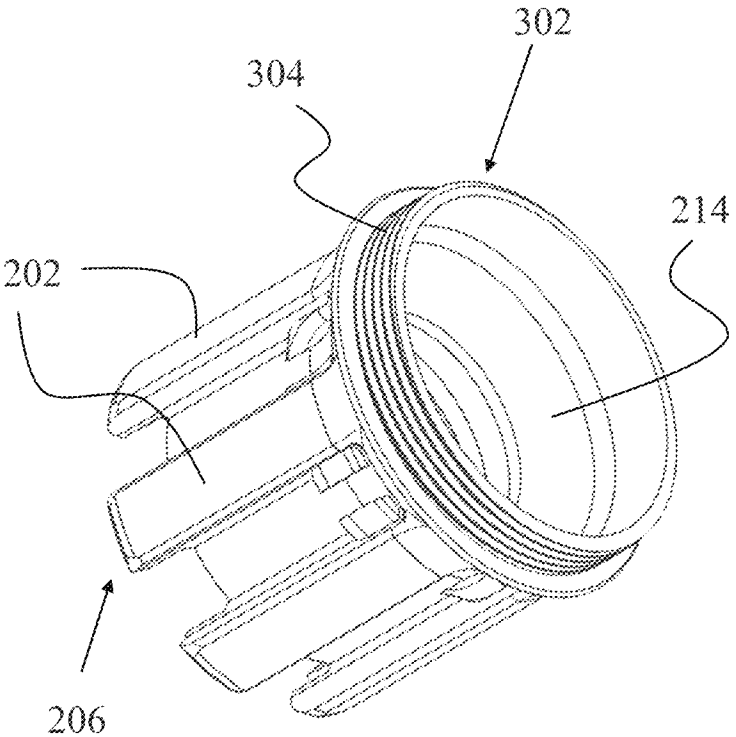
FIG. 3 is a perspective view of a distal end of the suppressor connector for firearms of FIG. 2, in accordance with the present invention.

To protect the flexible pawls 201, and as shown in FIG. 2, the present invention provides at least one outer hood 202 that covers the flexible pawl 201 and protects it from the extraneous impact of other objects. FIGS. 3 & 4 provide views of the outer hoods 202 and illustrate the fact that the flexible pawls 201 are safely obscured under the outer hoods 202. Each outer hood 202 has a distal end 220 coupled to the suppressor connector 200 proximate to the distal end 216 of the flexible pawl 201. A free-floating proximal end 222 of the outer hood 202 at least partially covers the free-floating proximal end 218 of the flexible pawl 201. In one embodiment, the outer hood 202 extends beyond and substantially parallel to the free-floating proximal end 218 of the flexible pawl 201. FIG. 2 shows this arrangement.

A length 222 of each flexible pawl 201 extending between the proximal and distal ends of the at least one flexible pawl defines a gap 224 between the length 222 of the flexible pawl 201 and an outside surface 226 of the proximal end threads. Similarly, the length 222 of each flexible pawl 201 extending between the proximal and distal ends of the at least one flexible pawl defines a gap 228 between the length 222 of the flexible pawl 201 and an inside surface 230 of the at least one outer hood 202. The two gaps 224, 228, allow the flexible pawl 201 to flex, i.e., bend/deform, from its static position when a force is applied to it., e.g., when it is place in spring pressure against the engagement ring 106 and engagement teeth 108.

The flexible pawls 201 utilize elastic deformation to achieve a range of motion. Such a structure is sometimes referred to as a "flexure." Flexure designs are known for their precision and lack of friction due to the absence of sliding or rolling contacts. As explained below, the present invention achieves a ratcheting motion between the suppressor connector 300 and the engagement ring 106 through the flexible pawls 201 that bend/flex to allow movement.

Figure 1:
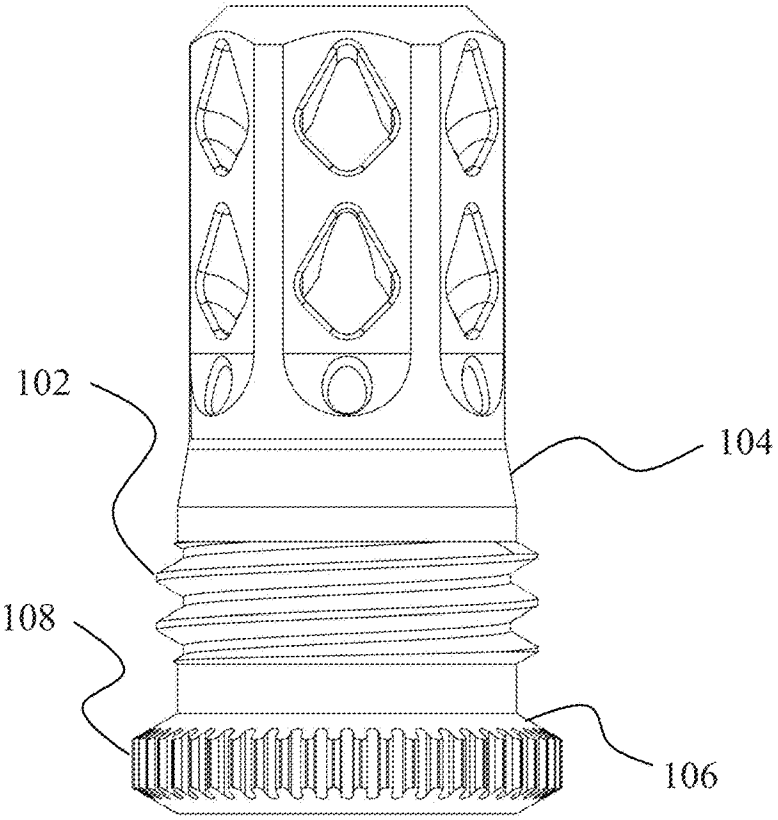
FIG. 1 (Prior Art)
FIG. 1 is a side elevational view of a prior-art muzzle device with threads, an engagement ring, and engagement teeth.
Figure 6:
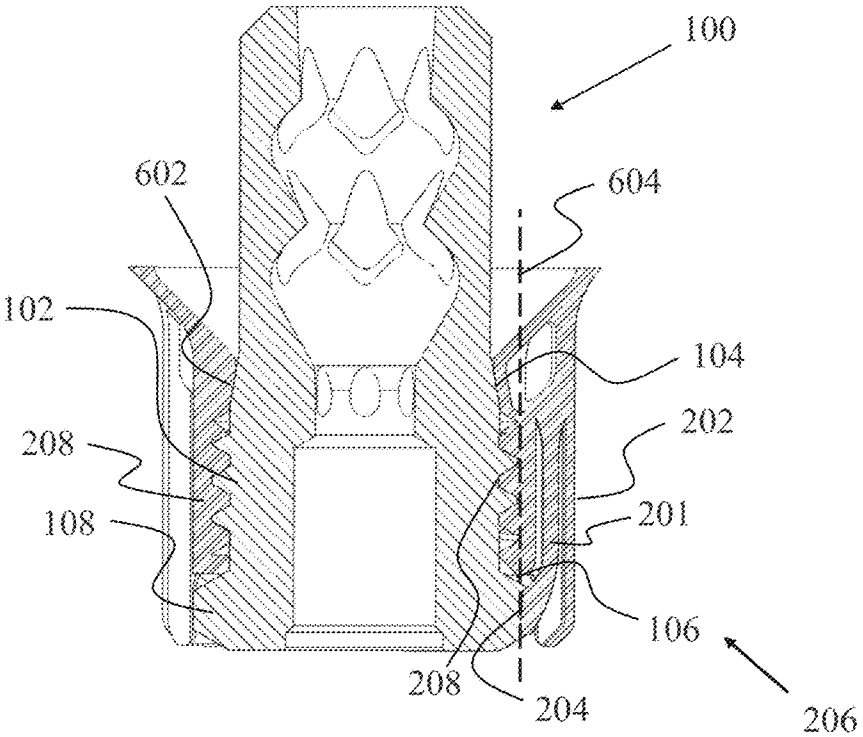
FIG. 6 is a fragmentary, side elevational view of the suppressor connector for firearms of FIG. 2 coupled to the muzzle device of FIG. 1, in accordance with the present invention.

FIG. 6 shows a fragmentary, side elevational view of the suppressor connector 200 coupled to the muzzle device 100 shown in FIG. 1. This view shows how the two components nest on top of one another. The threads 102 of the muzzle device 100 mate with the threads 208 of the suppressor connector 200 in a typical male/female thread screwing arrangement. The components are screw tightened onto one another until a seat 602 of the suppressor connector 200 mates against the alignment taper 104 of the muzzle device 100.

The components are sized and shaped so that when the threads 102 of the muzzle device 100 mate with the threads 208 of the suppressor connector 200 and the seat 602 of the suppressor connector 200 mates against the alignment taper 104 of the muzzle device 100, the engagement face 204 of each flexible pawl 201 is in spring contact, but not necessarily seated within, the engagement teeth 108 of the engagement ring 106. When in this seated arrangement, the plurality of flexible pawls 201 secure the suppressor connector 200 to the muzzle device 100 and prevents the two components from becoming separated from each other. The engagement teeth 108 provide a plurality of hills and valleys that selectively mate with the flexible pawls 201, although not necessarily all at the same time. In this mated position shown in FIG. 6, the engagement face 204 of each pawl 201 is in substantial longitudinal alignment 604 with the proximal end threads 208.

Figure 5:
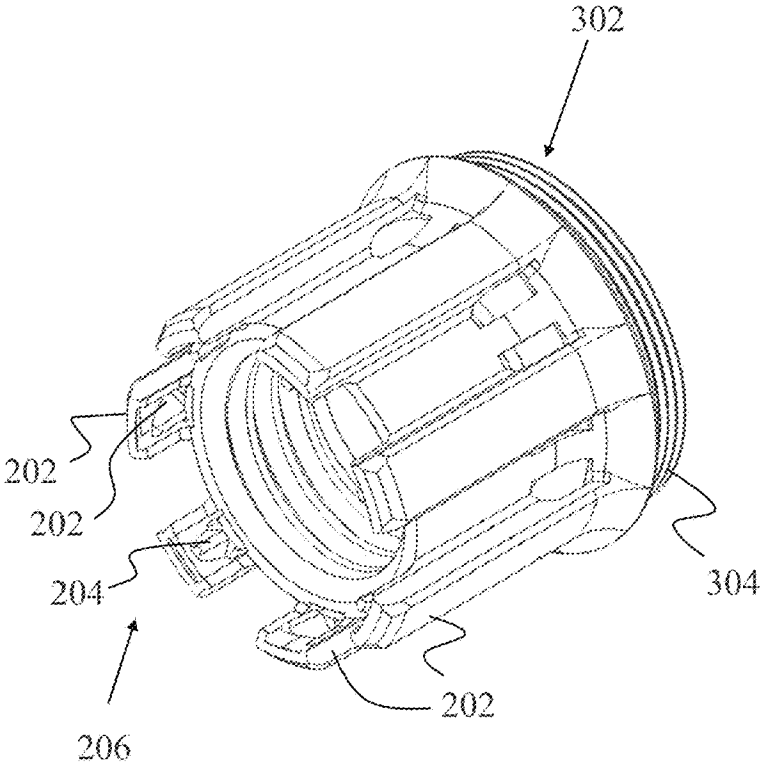
FIG. 5 is a perspective view of a proximal end of the suppressor connector for firearms of FIG. 2, in accordance with the present invention.
Figure 7:
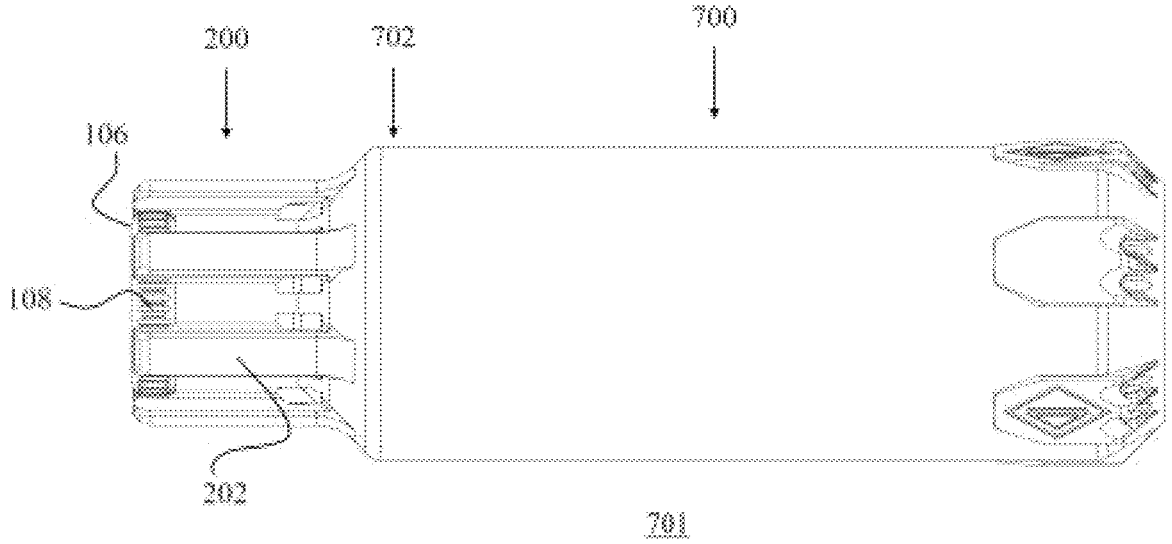
FIG. 7 is a side elevational view of the suppressor connector for firearms of FIG. 2 connected to a suppressor and the prior-art muzzle device of FIG. 1, in accordance with the present invention.

FIG. 7 is a side elevational view of the suppressor connector 200 connected to a suppressor 700. The suppressor 700 can be one of many choices of suppressors. The two components, 200 and 700, are attached to one another via the distal threads 304 at the distal end 302 of the suppressor connector 200, which are illustrated in FIGS. 3-5, and the non-illustrated threads at the proximal end 702 of the suppressor 700. The two sets of threads, like the threads 102 of the muzzle device 100 and the threads 208 of the suppressor connector 200, have interlocking helical ridges that frictionally couple to each other. More specifically, the suppressor connector 200 has external (male) threads 304 on its distal end 302 that spiral around its cylindrical or conical surface. This structure is similar to a bolt, screw, or threaded rod. The word "friction" or "frictionally," as used herein, is intended to mean the resistance that one surface or object encounters when moving over another. More resistance results in more friction.

The suppressor 700 features an internal (female) thread. This component contains recessed grooves, known as internal threads, inside its cylindrical or conical cavity. This structure is similar to nuts, threaded holes, or pipe fittings.

The male and female components are brought into contact so that their threads align properly. The starting points of the threads must match to engage correctly. The male component is rotated, usually clockwise (for right-handed threads, the most common type). The external threads of the male component interlock with the internal threads of the female component. As the rotation continues, the threads pull the two components together, creating a secure attachment. The interlocking threads prevent separation along the axis unless reversed.

Because the connection between the suppressor 700 and the suppressor connector 200 needs to remain secure, the two components can be attached with significant tightening force applied. When this happens, the threads distribute force evenly, providing a strong connection between the two components 200, 700. Brute force tightening works well between the suppressor 700 and the suppressor connector 200 because they will typically not need to be separated in the field and, thus, the connection can be made in a workshop or any suitable location prior to using the firearm and where tools, such as wrenches and vices, can be used to secure the two together. In contrast, the suppressor 700 and the suppressor connector 200, as an assembly 701, are typically attached on an as-needed basis in the field, e.g., during a military operation. Therefore, it is desirable to attach and remove the suppressor/connector assembly 701 rapidly and easily without tools, but also in a way that prevents them from unintendedly separating from one another.

Figure 8:
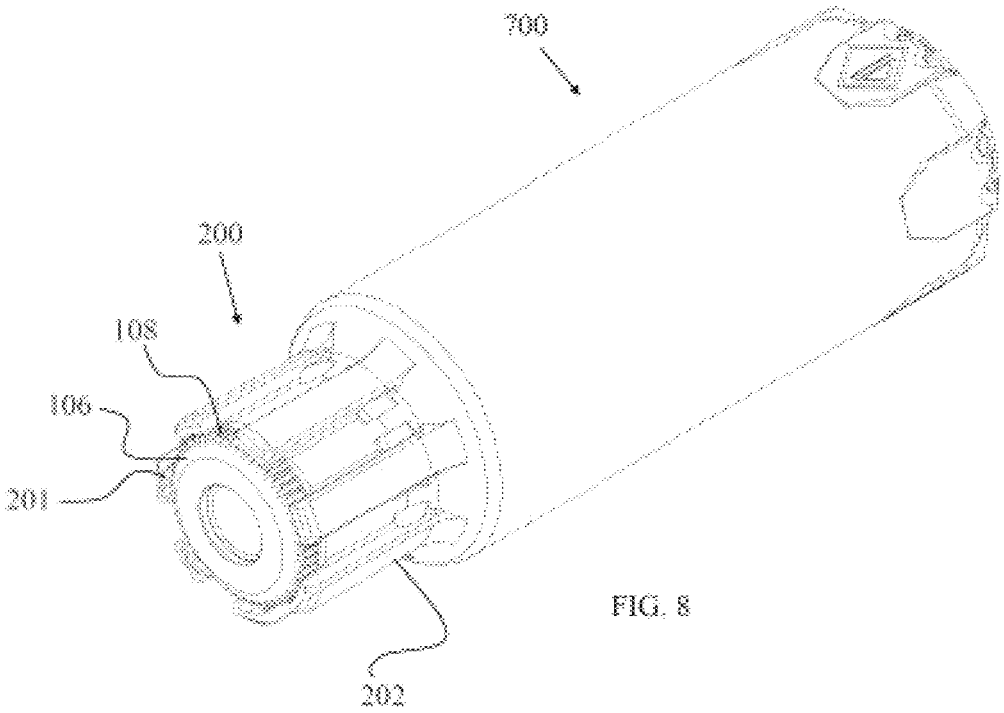
FIG. 8 is a perspective view of the proximal end of the suppressor connector for firearms of FIG. 2 connected to the suppressor of FIG. 7 and the prior-art muzzle device of FIG. 1, in accordance with the present invention.

FIG. 8 provides a perspective view of the proximal end of the suppressor/connector assembly 701 and, in particular, shows the pawls 201 in mechanical engagement with the engagement teeth 108 of the engagement ring 106. The free-floating proximal pawl ends 218 provide biased spring contact against the plurality of engagement teeth 108 in such a way that the suppressor connector 200 cannot rotate with relation to the muzzle device 100 without significant, e.g., hand, force being applied. When the two components, the suppressor connector 200 and the muzzle device 100, are rotated, one with relation to the other, the free-floating proximal pawl ends 218 provide a sort of bi-directional ratchet structure that selectively engages in both directions. As they do so, one or more of the free-floating proximal pawl ends 218 flex to engage or disengage with the engagement teeth 108, enabling controlled motion in either direction.

Figure 9:
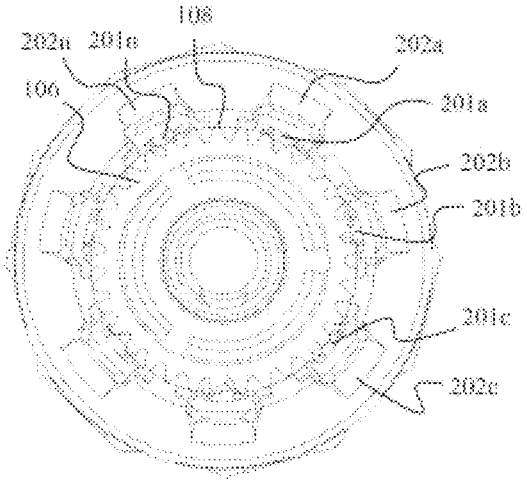
FIG. 9 is an elevational view of the proximal end of the suppressor connector for firearms of FIG. 2 connected to prior-art muzzle device of FIG. 1, in accordance with the present invention.

FIG. 9 is an elevational view of the proximal end of the suppressor connector for firearms of FIG. 2 connected to a prior-art muzzle device 100 similar to that shown in FIG. 1. This view shows a plurality of protective hoods 202*a-n*, where "a-n" represents a series starting at 1 and which is indexed a value "n" that is any number between zero and infinity. In other words, the number of hoods 202 is not limited to any quantity more than one. Each of the plurality of protective hoods 202*a-n* cover a corresponding one of a plurality of flexible pawls 201*a-n*, where "a-n" represents a series starting at 1 and which is indexed a value "n" that is any number between zero and infinity. In other words, the number of hoods 202 is not limited to any quantity more than one. Each of the plurality of flexible pawls 201*a-n* is in contact with the engagement ring 106.

Figure 10:
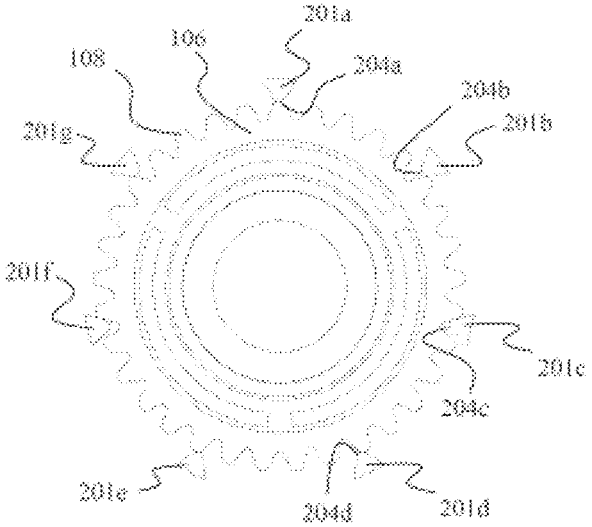
FIG. 10 is a fragmentary elevational proximal view of the engagement ring of the prior-art muzzle device of FIG. 1 with a plurality of pawls surrounding the engagement teeth, in accordance with the present invention.

In accordance with an embodiment of the present invention, some of the plurality of flexible pawls 201*a-n* align with a valley between two of the plurality of engagement teeth 108, while others of the plurality of flexible pawls 201*a-n* do not align with the valleys. Instead, these flexible pawls 201*a-n* rest on top of or are somewhat aligned on top of engagement teeth 108. This purposeful alignment/non-alignment is illustrated in FIG. 10, which is a fragmentary elevational proximal view of the engagement ring of the prior-art muzzle device of FIG. 1. More specifically, the engagement face 204*a* of a first flexible pawl 201*a* is shown resting substantially directly on top of an engagement tooth 108. An engagement face 204*b* of a second flexible pawl 201*b* is shown as being partially resting between two of the plurality of engagement teeth 108. An engagement face 204*c* of a third flexible pawl 201*c* is shown as resting substantially all of the way between two of the plurality of engagement teeth 108. An engagement face 204*d* of a fourth flexible pawl 201*d* is shown as resting substantially on top of one of the plurality of engagement teeth 108. The alignment of some of the flexible pawls 201*a-n* between two of the plurality of engagement teeth and misalignment of other of the flexible pawls 201*a-n* and engagement teeth 108 advantageously ensures that, regardless of the exact alignment between the muzzle device 100 and suppressor connector 200, at least one of the plurality of flexible pawls 201*a-n* will be engaged between two of the engagement teeth and thereby providing significant resistance to rotation of the two components with relation to one another, thus preventing the muzzle device 100 and suppressor connector 200 from unintendedly rotating relative to one another and coming unattached. Each amount of rotation might dislodge one of the plurality of flexible pawls 201*a-n* from between two engagement teeth 108, but that same rotation will also cause others of the plurality of flexible pawls 201*a-n* to drop down between two of the plurality of flexible pawls 201*a-n*, thereby ensuring a particular amount of resistance is always present.

Figure 11:
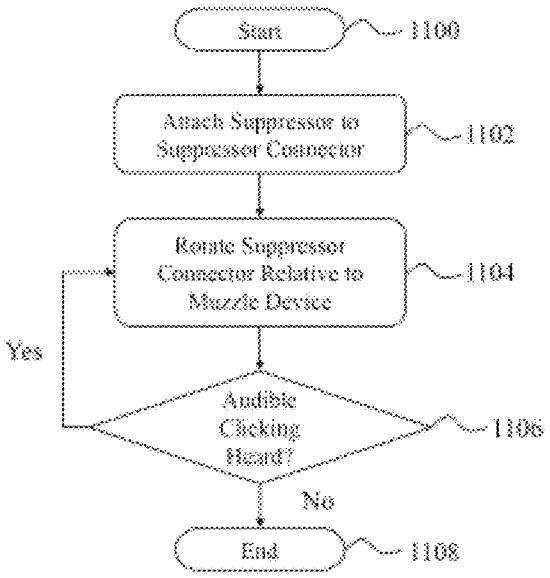
FIG. 11 is a process flow chart showing a process of attaching a supressor to the muzzle of a firearm, in accordance with the present invention.

FIG. 11 is a process flow chart showing a process of attaching a suppressor 700 to the muzzle device 100 of a firearm in accordance with the present invention. The process starts at step 1100 and immediately proceeds to step 1102, where a suppressor 700 is attached to the suppressor connector 200 via any suitable method of attachment, e.g., by rotating one with relation to the other. The process then moves to step 1104, where the suppressor connector 200 is attached to the muzzle device 100 by rotating the suppressor connector 200 with relative to the muzzle device 100. The rotation takes place until the suppressor connector 200 seats firmly against the alignment taper 104 of the muzzle device 100 and an audible clicking noise emitted from the flexible pawls 201*a-n* along the engagement teeth 108 is no longer heard in step 1106. At this point, the firearm is ready to be used and the process ends at step 1108.

Figure 12:
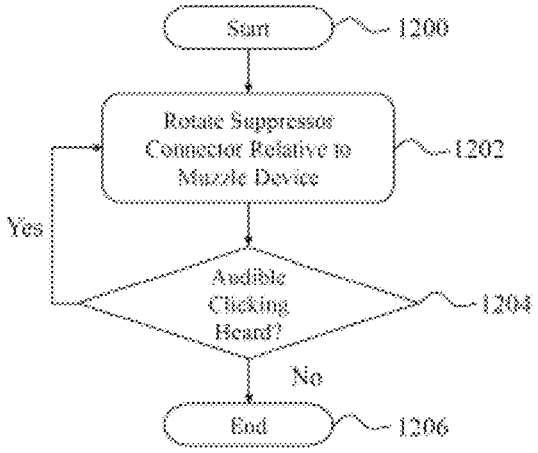
FIG. 12 is a process flow chart showing a process of removing a suppressor from the muzzle of a firearm, in accordance with the present invention.

FIG. 12 is a process flow chart showing a process of removing a suppressor 700 from the muzzle device 100 of a firearm in accordance with the present invention. The process starts at step 1200 and immediately proceeds to step 1202, where a user rotates the suppressor connector 200 with reference to the muzzle device 100. The rotation takes place until, in step 1204, an audible clicking noise emitted from the flexible pawls 201*a-n* along the engagement teeth 108 is no longer heard. The process ends at step 1206.

A suppressor connector has been disclosed that features a flexure mechanism integrally designed into its host component, functioning as a unidirectional or bi-directional ratcheting system without requiring additional materials or supplemental accessories. The inventive design can encompass both additive and subtractive manufacturing methods. Embodiments of the present invention include variations in the shape, orientation, or composition of the pawls, provided they rely on a flexure mechanism to provide tension into a mating component. Even if a pawl incorporates an additional material or component for enhanced wear resistance—resulting in a two-piece flexure assembly—it remains within the scope of the present invention, as the system still fundamentally utilizes the novel flexure mechanism. Any attempts to modify the pawl by adding components do not circumvent the integral nature of the system if the flexure mechanism continues to provide the required tension.

The claims appended hereto are meant to cover all modifications and changes within the scope and spirit of the present invention.

What is claimed is:

1. A suppressor connector comprising:

a distal end with distal end threads that are operable to couple the suppressor connector to a suppressor device;

a proximal end with proximal end threads that are operable to couple the suppressor connector to a muzzle of a firearm, the proximal end threads having a distal thread end and a proximal thread end;

at least one flexible pawl having:

a distal end coupled to the suppressor connector proximate to the distal thread end of the proximal end threads;

a free-floating proximal end that terminates beyond the proximal thread end of the proximal end threads of the suppressor connector; and an engagement face on the free-floating proximal end; and at least one outer hood having:

a distal end coupled to the suppressor connector proximate to the distal end of the flexible pawl; and a free-floating proximal end that at least partially covers the free-floating proximal end of the flexible pawl and that extends beyond and substantially parallel to the free-floating proximal end of the flexible pawl.

2. The suppressor connector according to claim 1, further comprising:

a bore alignment taper at a distal end of the distal end threads of the distal end of the suppressor connector.

3. The suppressor connector according to claim 1, further comprising:

a length of the at least one flexible pawl extending between the proximal and distal ends of the at least one flexible pawl is flexibly movable with respect to the proximal end threads.

4. The suppressor connector according to claim 1, further comprising:

a length of the at least one flexible pawl extending between the proximal and distal ends of the at least one flexible pawl is flexibly movable with respect to the at least one outer hood.

5. The suppressor connector according to claim 1, further comprising:

a length of the at least one flexible pawl extending between the proximal and distal ends of the at least one flexible pawl extends substantially parallel to the proximal end threads.

6. The suppressor connector according to claim 1, wherein:

a length of the at least one flexible pawl extending between the proximal and distal ends of the at least one flexible pawl defines a gap between the length of the flexible pawl and an outside surface of the proximal end threads.

7. The suppressor connector according to claim 1, wherein:

a length of the at least one flexible pawl extending between the proximal and distal ends of the at least one flexible pawl defines a gap between the length of the flexible pawl and an inside surface of the at least one outer hood.

8. The suppressor connector according to claim 1, wherein:

the at least one outer hood at least partially covers the at least one flexible pawl on three sides thereof.

9. The suppressor connector according to claim 1, wherein:

the engagement face of the at least one flexible pawl is in substantial longitudinal alignment with the proximal end threads.

10. A method of coupling a suppressor to a firearm, the method comprising:

providing a muzzle device having:

an engagement ring;

a plurality of engagement teeth; and a set of threads;

providing a suppressor connector having:

a distal end with distal end threads that are operable to couple the suppressor connector to the suppressor;

a proximal end with proximal end threads that are operable to couple the suppressor connector to the muzzle device, the proximal end threads having a distal thread end and a proximal thread end;

at least one flexible pawl having:

a distal end coupled to the suppressor connector proximate to the distal thread end of the proximal end threads;

a free-floating proximal end that terminates beyond the proximal thread end of the set of proximal end threads of the suppressor connector; and an engagement face on the free-floating proximal end; and at least one outer hood having:

a distal end coupled to the suppressor connector proximate to the distal end of the flexible pawl; and a free-floating proximal end that at least partially covers the free-floating proximal end of the flexible pawl and that extends beyond and substantially parallel to the free-floating proximal end of the flexible pawl; and coupling the suppressor connector to the muzzle device.

11. The method according to claim 10, wherein the step of coupling the suppressor connector to the muzzle device comprises:

placing the suppressor connector in physical contact with the muzzle device and rotating the suppressor connector relative to the muzzle device.

12. The method according to claim 10, further comprising:

coupling the suppressor to the suppressor connector prior to the step of coupling the suppressor connector to the muzzle device.

13. The method according to claim 10, wherein the suppressor connector comprises:

a bore alignment taper at a distal end of the distal end threads of the distal end of the suppressor connector.

14. The method according to claim 10, wherein:

a length of the at least one flexible pawl extending between the proximal and distal ends of the at least one flexible pawl is flexibly movable with respect to the proximal end threads.

15. The method according to claim 10, wherein:

a length of the at least one flexible pawl extending between the proximal and distal ends of the at least one flexible pawl is flexibly movable with respect to the at least one outer hood.

16. The method according to claim 10, wherein:

a length of the at least one flexible pawl extending between the proximal and distal ends of the at least one flexible pawl extends substantially parallel to the proximal end threads.

17. The method according to claim 10, wherein:

a length of the at least one flexible pawl extending between the proximal and distal ends of the at least one flexible pawl defines a gap between the length of the flexible pawl and an outside surface of the proximal end threads.

18. The method according to claim 10, wherein:

a length of the at least one flexible pawl extending between the proximal and distal ends of the at least one flexible pawl defines a gap between the length of the at least one flexible pawl and an inside surface of the at least one outer hood.

19. The method according to claim 10, wherein:

the at least one outer hood at least partially covers the at least one flexible pawl on three sides thereof.

20. The method according to claim 10, wherein:

the engagement face of the at least one flexible pawl is in substantial longitudinal alignment with the proximal end threads.

* * * * *